US008407847B1

(12) United States Patent
Li

(10) Patent No.: US 8,407,847 B1
(45) Date of Patent: Apr. 2, 2013

(54) WET AND DRY DISPOSABLE CLOTH SWEEPER

(75) Inventor: Quan Li, Queens, NY (US)

(73) Assignee: Casabella Holdings, LLC, Congers, NY (US)

( * ) Notice: Subject to any disclaimer, the term of this patent is extended or adjusted under 35 U.S.C. 154(b) by 0 days.

(21) Appl. No.: 13/474,164

(22) Filed: May 17, 2012

Related U.S. Application Data

(60) Provisional application No. 61/597,551, filed on Feb. 10, 2012.

(51) Int. Cl.
*A47L 13/16* (2006.01)

(52) U.S. Cl. ..... 15/228; 15/104.94; 15/231

(58) Field of Classification Search ..... 15/104.94, 15/228, 231, 232
See application file for complete search history.

(56) References Cited

U.S. PATENT DOCUMENTS

| | | | | |
|---|---|---|---|---|
| 4,852,210 | A * | 8/1989 | Krajicek | 15/228 |
| 5,839,147 | A * | 11/1998 | Chia-Yi et al. | 15/119.2 |
| 6,386,392 | B1 | 5/2002 | Argentieri et al. | |
| D485,178 | S | 1/2004 | Pouillot et al. | |
| 6,797,357 | B2 | 9/2004 | Fereshtehkhou et al. | |
| 6,936,330 | B2 | 8/2005 | Fereshtehkhou et al. | |
| 7,565,715 | B2 * | 7/2009 | Harper et al. | 15/228 |
| 7,568,255 | B1 * | 8/2009 | Krebs | 15/104.93 |
| D602,218 | S | 10/2009 | Koenig et al. | |
| D617,066 | S | 6/2010 | Koenig et al. | |
| 2005/0081888 | A1 | 4/2005 | Pung et al. | |

* cited by examiner

*Primary Examiner* — Shay Karls
(74) *Attorney, Agent, or Firm* — Curtis, Mallet-Prevost, Colt & Mosle LLP

(57) ABSTRACT

Disclosed is a wet and dry disposable cloth sweeper that has a cleaning head with a cleaning body and a ridged substrate, push fit zippers for securing a cleaning pad, an annular universal joint with a handle connector for pivotally securing the cleaning head to a handle, and a handle connected to the cleaning head. The wet and dry disposable cloth sweeper may be a cleaning kit having a cleaning head, a handle, and optionally cleaning pads.

20 Claims, 6 Drawing Sheets

WET AND DRY DISPOSABLE CLOTH SWEEPER

This application claims the benefit of U.S. Provisional Application No. 61/597,551, filed on Feb. 10, 2012.

BACKGROUND OF THE INVENTION

1. Field of the Invention

This invention relates generally to cleaning devices, and more specifically to a wet and dry disposable cloth sweeper.

2. Description of Related Art

Mops and dusters have been used for many years to clean hard surface floors and related surfaces. The term mop, duster, and sweeper all refer to similar cleaning devices, where such terms may be used interchangeably throughout this specification. Dry mopping or dusting is convenient in situations where the surface requires a light cleaning, and is not heavily soiled. Traditional dusters and sweepers collect dust and small particles with a single cleaning edge, but lack the ability to properly dispose of the collected dust and particles. In the past, when the cleaning surfaces of mops and dusters became soiled, the cleaning surfaces were themselves cleaned by shaking or tamping the cleaning surface, rinsing the cleaning surface with water and perhaps a cleaning solution, or the like. These techniques were not always entirely effective at removing dirt and debris from the cleaning surface of the mop or duster. This allowed dirt and debris to be redistributed on the surfaces to be cleaned, creating smudges and a generally unclean condition. To address this problem, in recent years there has been a proliferation of mops and dusters that have a removable and disposable cleaning surface that allows a user to simply remove the disposable cleaning surface, discard it, and replace it with a new cleaning surface. In many of these mops and dusters, a removable and disposable cleaning surface typically makes contact with a generally flat bottomed cleaning head that is in turn attached to a handle. Such an arrangement, while adequate, does not provide an optimal cleaning surface. This is due in part to the flat nature of the contact surface of the cleaning head. While the flat surface of the bottom of such cleaning heads glides smoothly across a flat surface to be cleaned, such as a floor, it lacks the frictional and structural features necessary to provide improved cleaning.

What is needed is a mop, duster, or sweeper that has the ability to collect dust and particles on a disposable or removable surface. What is further needed is a mop, sweeper, or sweeper that has a plurality of cleaning edges to increase the cleaning ability of the sweeper and further that has additional attributes to compliment and enhance the efficacy of the to cleaning edges and surfaces.

It is thus an object of the present invention to provide a wet and dry disposable cloth sweeper that has a removable cleaning surface. It is another object of the present invention to provide a wet and dry disposable cloth sweeper that has a plurality of cleaning edges. It is another object of the present invention to provide a wet and dry disposable cloth sweeper that has a cleaning head with novel retention structures for placement of a removable cleaning surface. It is another object of the present invention to provide a wet and dry disposable cloth sweeper that has a novel attachment structure for attachment and range of motion of the cleaning pad to a handle. These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a wet and dry disposable cloth sweeper that has a cleaning head comprising a cleaning head body and a substrate joined to the cleaning head body, the substrate having a plurality of ridges, a first push fit zipper and a second push fit zipper coupled to the cleaning head body; and a handle attached to the cleaning head with an annular universal joint having a handle connector.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
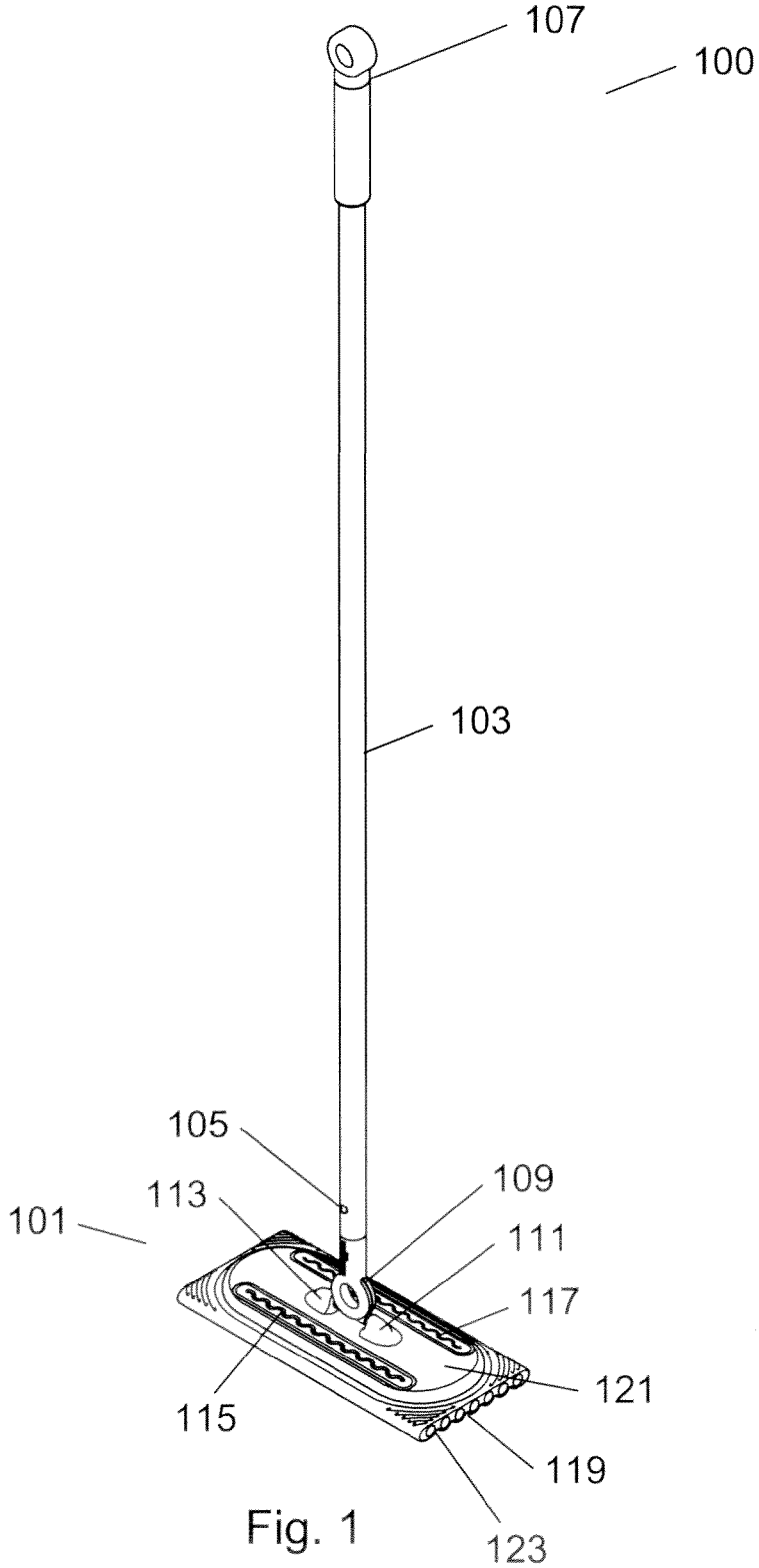
FIG. 1 is a perspective view of the Wet and Dry Disposable Cloth Sweeper.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims and the attached drawings.

DESCRIPTION OF THE PREFERRED EMBODIMENTS

A wet and dry disposable cloth sweeper is described and depicted in the attached drawings. The term sweeper, as used herein, refers to a cleaning device that removes dirt, debris, liquids, and other undesirable materials, from a surface such as a floor, stairs, a counter, or the like. The term sweeper may include mops, dusters, brushes, cleaners, and the like.

For a general understanding of the present invention, reference is made to the drawings. In the drawings, like reference numerals have been used throughout to designate identical elements.

Figure 4:
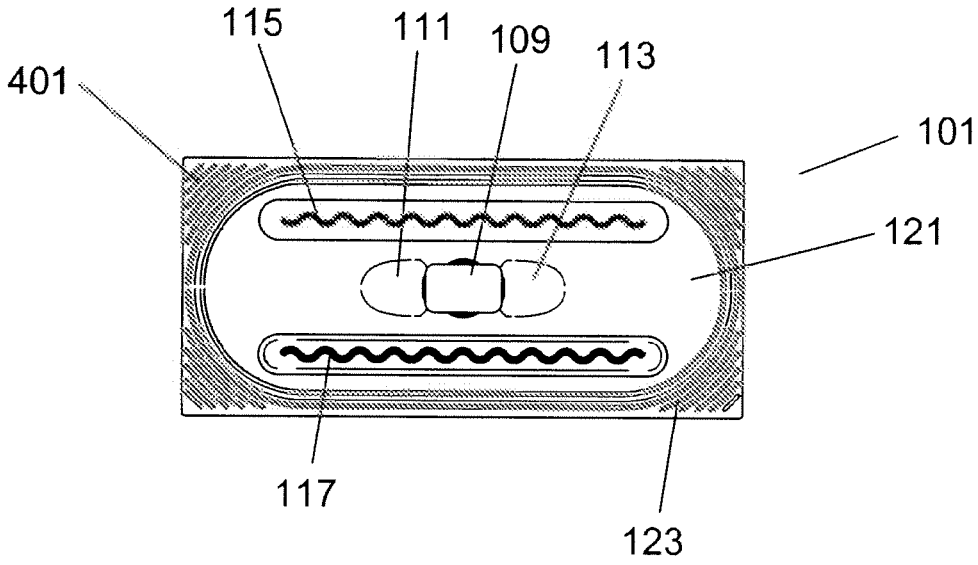
FIG. 4 is a top plan view of the cleaning head of the Wet and Dry Disposable Cloth Sweeper.
Figure 5:
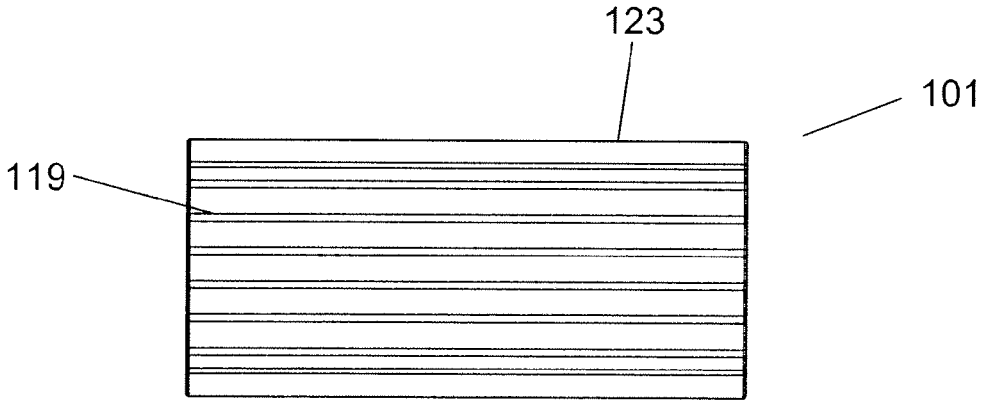
FIG. 5 is a bottom plan view of the cleaning head of the Wet and Dry Disposable Cloth Sweeper.
Figure 7:
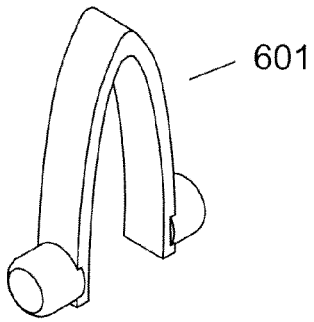
FIG. 7 is a perspective view of a pin clip retainer of the Wet and Dry Disposable Cloth Sweeper.

Referring to FIG. 1, a perspective view of the Wet and Dry Disposable Cloth Sweeper 100 is shown. Depicted is a cleaning head 101 that is also shown in FIGS. 4 and 5 in further detail. The cleaning head 101 comprises a cleaning head body 121 and a substrate 123 joined to the cleaning head body. The cleaning head body 121 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The cleaning head body 121 may be made by injection molding, blow molding, machining, or the like. Attached to the cleaning head body 121 is a substrate 123. The substrate 123 may be made from a material that has resilient characteristics, such as a closed cell or an open cell foam. An example of a suitable foam is Ethylene Vinyl Acetate foam. The substrate 123 may be molded, machined, or the like. The substrate 123 has a plurality of ridges 119. The ridges provide both frictional and structural attributes necessary to provide improved cleaning over a standard planar structure without such features. In some embodiments of the present invention, the ridges are of a generally tubular shape, and may be, in some embodiments of the present invention, hollow. The ridges traverse the length of the substrate, and may also have additional structural features or geometries. In some embodiments of the present invention, the ridges along the outer edges of the substrate are wider than the remaining ridges, and may have increased wall thickness, different physical properties such as durometer, or the like. The cleaning head body 121 and the substrate 123 are joined as depicted in FIG. 1 using a suitable adhesive, or they may be over molded, thermo fused, sonically welded, heat welded, solvent welded, or the like. A first push fit zipper 115 and a second push fit zipper 117 can also be seen in FIG. 1. The push fit zippers are essentially soft durometer materials with a curvilinear or otherwise non-linear opening. A suitable material being, for example, thermoplastic rubber. The opening of each push fit zipper serves to retain a cleaning pad such as a disposable cleaning pad, a microfiber cleaning pad, or the like. The push fit zippers are contained in openings in the cleaning head body 121, and may be over molded into the openings, or fastened by a suitable adhesive, or they may be thermo fused, sonically welded, heat welded solvent welded, or the like. The curvilinear or otherwise non-linear opening in the push fit zipper provides a reticulated opening that retains a cleaning pad. FIG. 10 depicts the push fit zippers in use holding a cleaning pad. The cleaning head is attached to a handle with a novel annular universal joint 109. The annular universal joint 109 is further depicted by way of FIGS. 8 and 9. The annular universal joint 109 comprises an inner annular joint and an outer annular joint, and may be made from any suitable material such as a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may suitably formed may also be used. The inner annular joint of the annular universal joint 109 has an annulus connected to a pivot bar, a first pivot pin connected to the pivot bar, and a second pivot pin connected to the pivot bar. Attached to the cleaning head body 121 is a first pivot pin receiver 111 and a second pivot pin receiver 113 for retaining the first pivot pin and the second pivot pin respectively. The pivot pin receivers may be molded, machined, or otherwise formed with the cleaning head body 121. In some embodiments of the present invention, the pivot pin receivers may be attached to the cleaning head body 121 using an adhesive, heat welding, sonic welding, solvent welding, mechanical fasteners, or the like. The annular universal joint 109 also has an outer annular joint that comprises a split annulus for receiving the inner annular joint and a handle connector stub for providing connectivity between the cleaning head 101 and the handle 103. Further details of the annular universal joint 109 will be described later in this specification by way of FIGS. 8 and 9. The annular universal joint 109, having a handle connector stub, is joined to the handle 103 by a handle connector 105. The handle connector 105 may be a pin clip retainer as depicted in FIG. 7, or may be a screw down connector, a threaded connector arrangement, a push in connector, or the like. The handle 103 may be made from a metal such as aluminum or steel tubing, a plastic, or wood. The handle 103 may optionally have a handle end 107 that provides features such as a retainer to hang up the sweeper, soft grip material, or the like.

Figure 2:
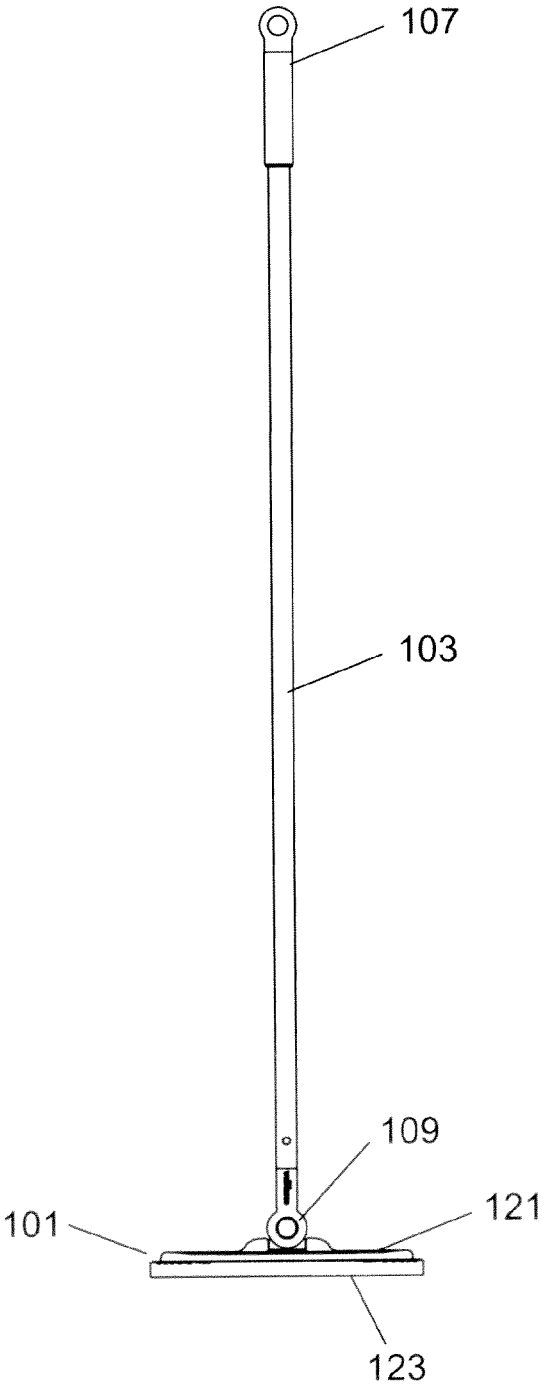
FIG. 2 is a plan view of the Wet and Dry Disposable Cloth Sweeper.

FIG. 2 is a plan view of the Wet and Dry Disposable Cloth Sweeper that clearly shows the annular universal joint 109.

Figure 3:
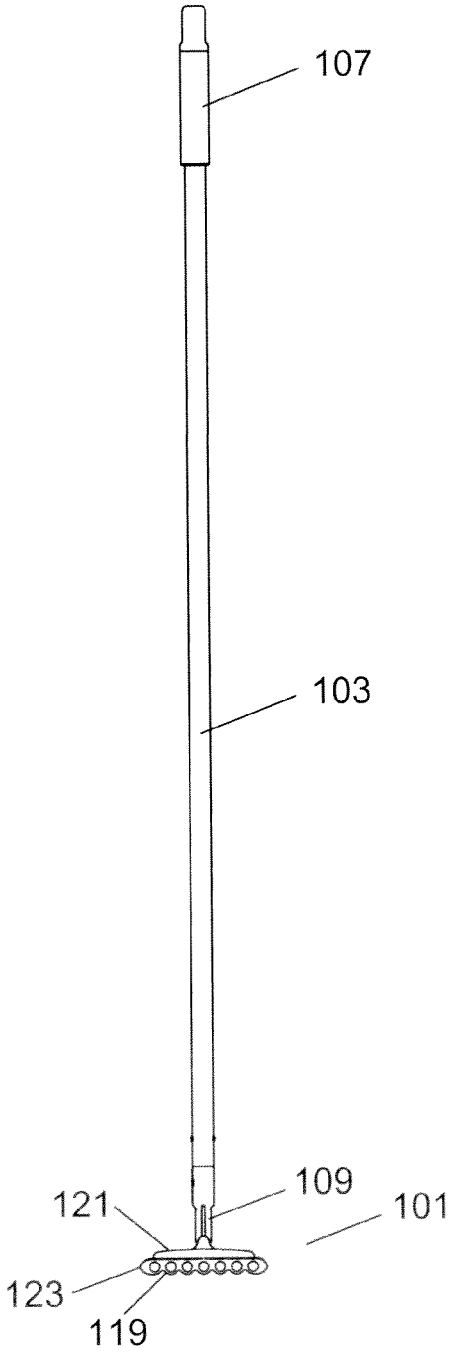
FIG. 3 is a side plan view of the Wet and Dry Disposable Cloth Sweeper.

FIG. 3 is a side plan view of the Wet and Dry Disposable Cloth Sweeper that clearly depicts the plurality of ridges 119 of the substrate 123. In FIG. 3, there are seven ridges depicted. Other embodiments of the present invention may have more or less ridges. Further, in the exemplary embodiment depicted in FIG. 3, the outer ridges have an exterior wall that is thicker than the remaining ridges, and the ridges are hollow and generally tubular. These geometric attributes may vary across different embodiments of the present invention.

FIG. 4 is a top plan view of the cleaning head of the Wet and Dry Disposable Cloth Sweeper. The cleaning head body 121 can be seen attached to the substrate 123. Depicted in FIG. 4 are the first push fit zipper 115 and the second push fit zipper 117. Also depicted in FIG. 4 are grooves 401 on the upper surface of the substrate 123. These grooves 401 are optional, and serve to further retain a cleaning pad when installed on the cleaning head 101.

FIG. 5 is a bottom plan view of the cleaning head of the Wet and Dry Disposable Cloth Sweeper, where examples of ridges 119 are depicted on the substrate 123. These ridges provide additional cleaning effectiveness not possible with a smooth surface.

Figure 6:
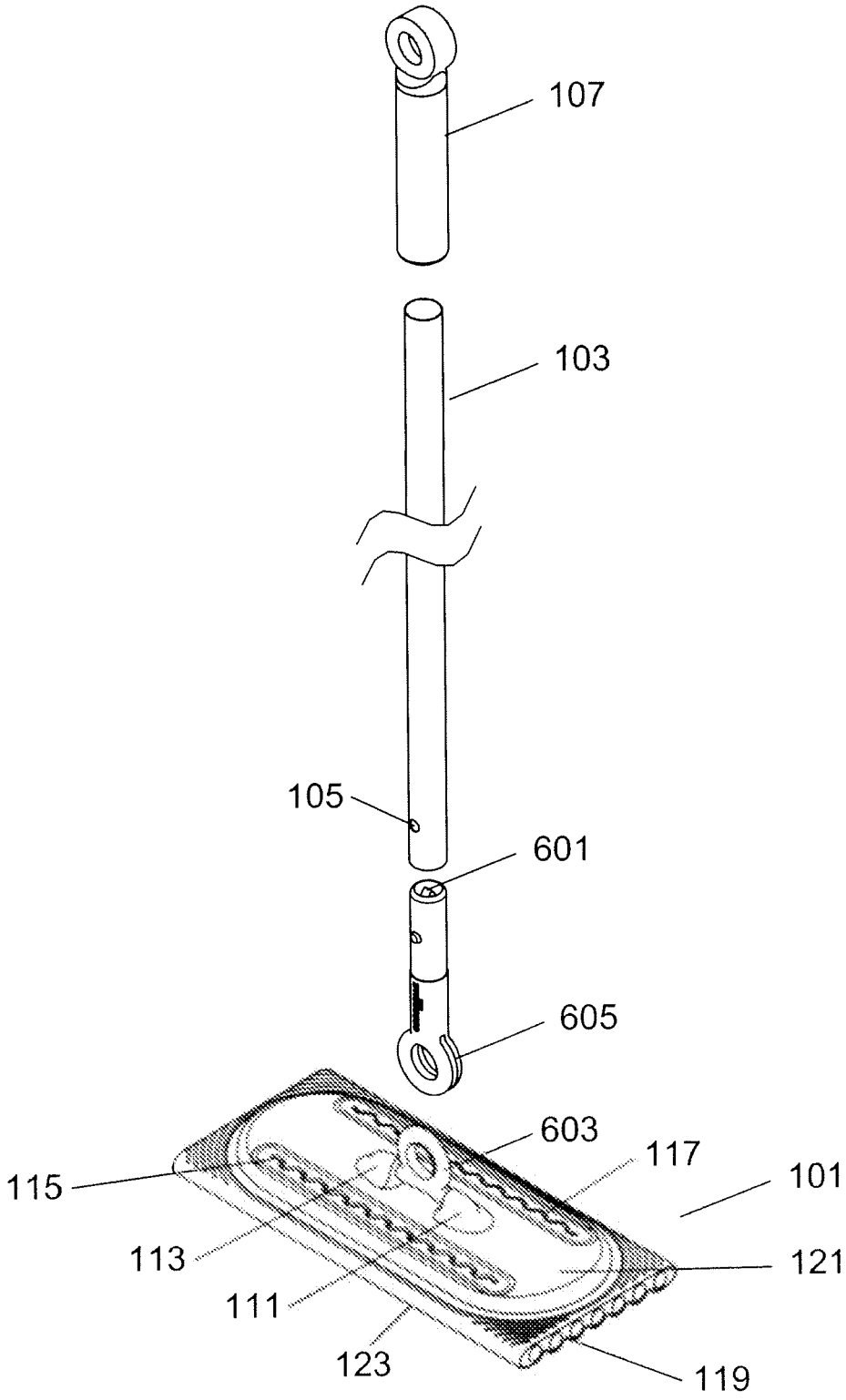
FIG. 6 is a partially disassembled perspective view of the Wet and Dry Disposable Cloth Sweeper.

FIG. 6 is a partially disassembled perspective view of the Wet and Dry Disposable Cloth Sweeper. The annular universal joint 109, as previously depicted in FIG. 1, has been disassembled to show the two primary working components, the inner annular joint 603 and the outer annular joint 605. These two joints are placed together such that they cooperate to provide a two dimensional range of motion along an axis. The inner annular joint 603 has a pivot bar and two pivot pins (not shown in FIG. 6, see FIG. 8) that are retained by a first pivot pin receiver 111 and a second pivot pin receiver 113 to provide an additional range of motion such that the annular universal joint 109 allows the cleaning head 101 to move along two axis while in use. The outer annular joint 605 also has a handle connector stub attached to a split annulus that may, in some embodiments of the present invention, receive a pin clip retainer 601 that provides removable retention of the handle 103 by way of a handle connector 105, such as, for example, two holes in the handle 103. Other techniques for retaining the handle to the annular universal joint and cleaning head include, but are not limited to, threads, retainer screws, bolts, push in fittings, pins, and the like.

FIG. 7 is a perspective view of a pin clip retainer 601 of the Wet and Dry Disposable Cloth Sweeper. The pin clip retainer, as previously described, serves to retain the handle to the annular universal joint and cleaning head. The pin clip retainer 601 may be made from a spring like material, such as a plastic.

Figure 8:
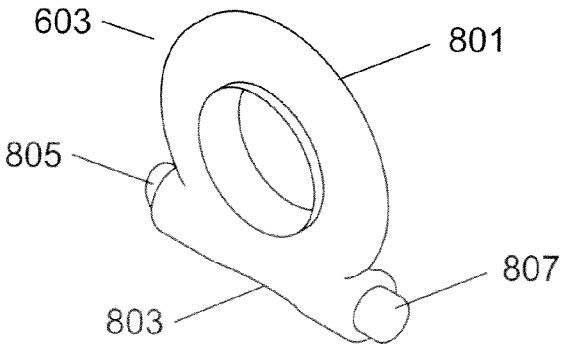
FIG. 8 is a perspective view of an inner annular joint of the Wet and Dry Disposable Cloth Sweeper.

FIG. 8 is a perspective view of an inner annular joint of the Wet and Dry Disposable Cloth Sweeper. The inner annular joint 603 comprises an annulus 801 that is connected to a pivot bar 803, a first pivot pin 805 connected to the pivot bar 803, and a second pivot pin 807 connected to the pivot bar 803. The annulus 801 may also have guiding structures such as a bezel, a frame, a track, or the like. The inner annular joint may be made from a plastic or a metal, for example, and may be made by injection molding, casting, machining, or the like.

Figure 9:
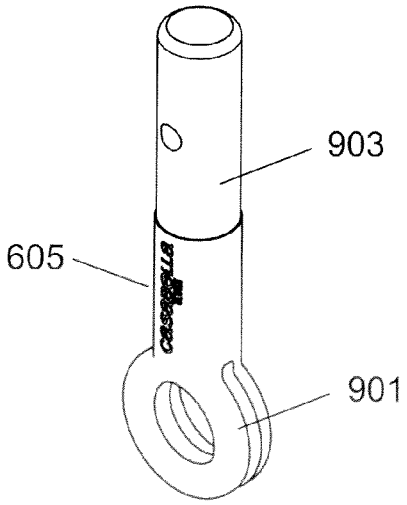
FIG. 9 is a perspective view of an outer annular joint of the Wet and Dry Disposable Cloth Sweeper.
Figure 10:
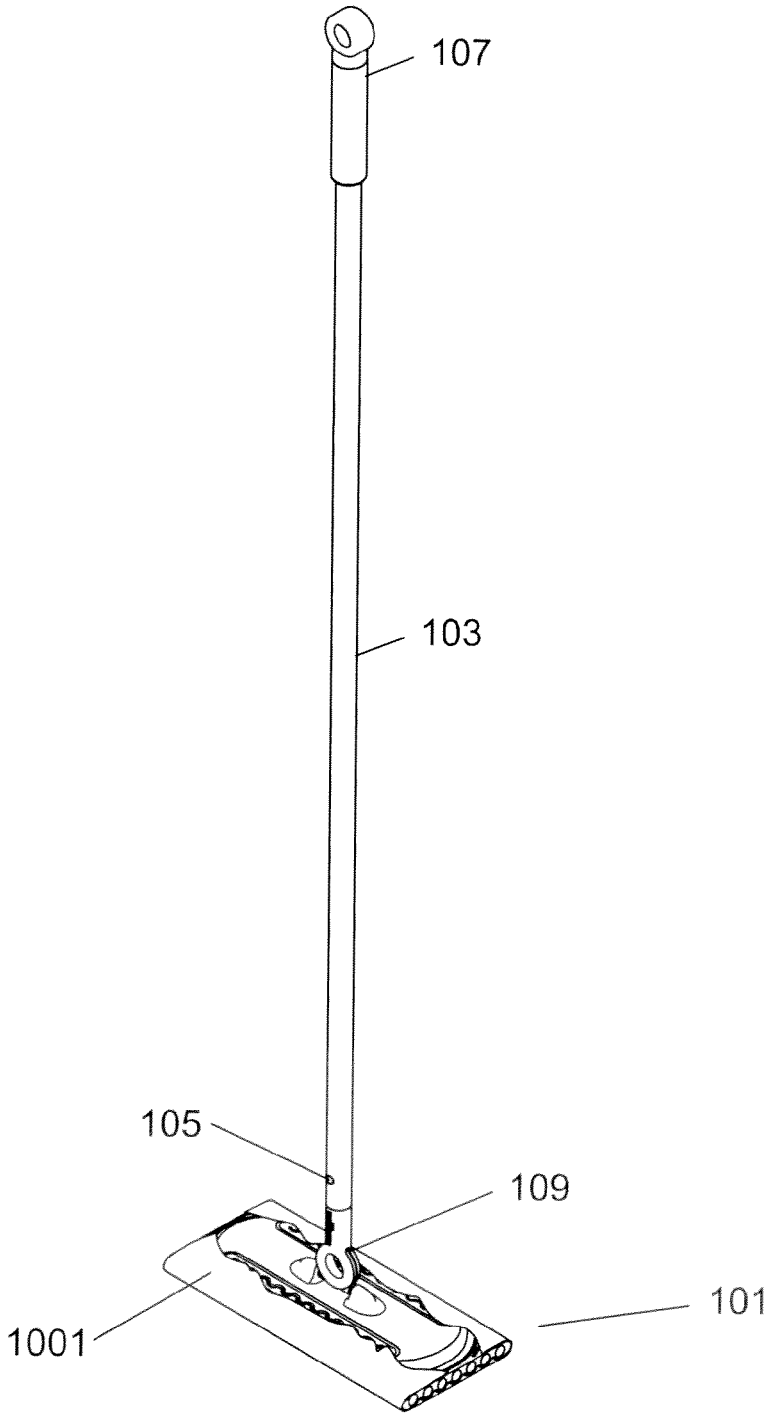
FIG. 10 is a perspective view of the Wet and Dry Disposable Cloth Sweeper in use with a cleaning cloth installed.

FIG. 9 is a perspective view of an outer annular joint of the Wet and Dry Disposable Cloth Sweeper. The outer annular joint 605 has a split annulus 901 for receiving the annulus 801 of the inner annular joint 603 (depicted in FIG. 8), and a handle connector stub 903 for retaining the handle of the Wet and Dry Disposable Cloth Sweeper to the annular universal joint and the cleaning head. Depicted in the handle connector stub 903 are holes for receiving a pin clip retainer such as the pin clip retainer 601 in FIG. 7. Other fastening techniques such as threads, screws, pins, and the like, may also be used. The outer annular joint may be made from a plastic or a metal, for example, and may be made by injection molding, casting, machining, or the like.

Lastly, FIG. 10 is a perspective view of the Wet and Dry Disposable Cloth Sweeper in use with a cleaning cloth 1001 installed. As evident from FIG. 10, the cleaning cloth 1001 is pushed into, and retained by, push fit zippers. The cleaning cloth 1001 may be a disposable cloth, paper, a microfiber cloth, or the like. In addition, the cleaning cloth 1001 may be impregnated or otherwise contain a cleaning solution.

The Wet and Dry Disposable Cloth Sweeper is used primarily to clean hard surfaces, such as floors. Hard surface flooring includes, but is not limited to, ceramic and porcelain tile, natural stone such as marble and granite, brick, cement, vinyl, wood, cork, bamboo, terrazzo, and the like. To use the Wet and Dry Disposable Cloth Sweeper, a cleaning cloth, and optionally cleaning solution, is placed on the cleaning head as shown in FIG. 10, and the Wet and Dry Disposable Cloth Sweeper is moved across the surface to be cleaned. Once cleaning is complete, the cleaning cloth is either discarded or cleaned. The range of motion provided by the annular universal joint combined with the plurality of ridges on the substrate provide cleaning effectiveness that has not heretofore been possible with sweepers, mops, dusters, or other cleaners.

It is, therefore, apparent that there has been provided, in accordance with the various objects of the present invention, a wet and dry disposable cloth sweeper. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims, and the attached drawings.

What is claimed is:

1. A wet and dry disposable cloth sweeper comprising:

a cleaning head comprising a cleaning head body and a substrate joined to the cleaning head body, the substrate having a plurality of ridges, a first push fit zipper and a second push fit zipper coupled to the cleaning head body; and a handle attached to the cleaning head with an annular universal joint having a handle connector.

2. The wet and dry disposable cloth sweeper of claim 1, wherein the annular universal joint comprises an inner annular joint and an outer annular joint.

3. The wet and dry disposable cloth sweeper of claim 2, wherein the annular universal joint comprises an inner annular joint having an annulus connected to a pivot bar, a first pivot pin connected to the pivot bar, and a second pivot pin connected to the pivot bar.

4. The wet and dry disposable cloth sweeper of claim 3, further comprising a first pivot pin receiver and a second pivot pin receiver for pivotally retaining the first pivot pin in the first pivot pin receiver and the second pivot pin in the second pivot pin receiver, whereas the first pivot pin receiver and the second pivot pin receiver are coupled to the cleaning head body.

5. The wet and dry disposable cloth sweeper of claim 2, wherein the annular universal joint comprises an outer annular joint having a split annulus.

6. The wet and dry disposable cloth sweeper of claim 2, wherein the annular universal joint comprises an outer annular joint having a split annulus and a handle connector stub attached to the split annulus.

7. The wet and dry disposable cloth sweeper of claim 1, wherein the first push fit zipper has a curvilinear opening.

8. The wet and dry disposable cloth sweeper of claim 1, wherein the second push fit zipper has a curvilinear opening.

9. The wet and dry disposable cloth sweeper of claim 1, further comprising a disposable cleaning pad.

10. The wet and dry disposable cloth sweeper of claim 1, further comprising a disposable cleaning pad impregnated with a cleaning solution.

11. The wet and dry disposable cloth sweeper of claim 1, wherein each ridge on the substrate is of a generally tubular shape.

12. The wet and dry disposable cloth sweeper of claim 1, wherein each ridge on the substrate is hollow.

13. A cleaning head comprising:

a cleaning head body and a substrate joined to the cleaning head body;

the substrate having a plurality of ridges;

a first push fit zipper and a second push fit zipper coupled to the cleaning head body; and an annular universal joint comprising an inner annular joint having an annulus connected to a pivot bar, a first pivot pin connected to the pivot bar, and a second pivot pin connected to the pivot bar, and an outer annular joint having a split annulus and a handle connector stub attached to the split annulus.

14. The cleaning head of claim 13, wherein the first push fit zipper has a curvilinear opening.

15. The cleaning head of claim 13, wherein the second push fit zipper has a curvilinear opening.

16. The cleaning head of claim 13, further comprising a disposable cleaning pad.

17. The cleaning head of claim 13, further comprising a disposable cleaning pad impregnated with a cleaning solution.

18. The cleaning head of claim 13, wherein each ridge on the substrate is of a generally tubular shape.

19. The cleaning head of claim 13, wherein each ridge on the substrate is hollow.

20. A cleaning kit comprising:

A cleaning head comprising a cleaning head body and a substrate joined to the cleaning head body, the substrate having a plurality of ridges, a first push fit zipper and a second push fit zipper coupled to the cleaning head body, and an annular universal joint comprising an inner annular joint having an annulus connected to a pivot bar, a first pivot pin connected to the pivot bar, and a second pivot pin connected to the pivot bar, and an outer annular joint having a split annulus and a handle connector stub attached to the split annulus;

a handle comprising a handle connector; and a disposable cleaning pad.

* * * * *